United States Patent [19]

March

[11] Patent Number: 4,529,069

[45] Date of Patent: Jul. 16, 1985

[54] CARRYING CASE

[75] Inventor: Joseph E. March, Chicago, Ill.

[73] Assignee: Platt Luggage, Inc., Chicago, Ill.

[21] Appl. No.: 468,575

[22] Filed: Feb. 22, 1983

Related U.S. Application Data

[63] Continuation-in-part of Ser. No. 228,672, Jan. 26, 1981, Pat. No. 4,374,555.

[51] Int. Cl.[3] ..... A45C 13/04; A45C 13/36

[52] U.S. Cl. ..... 190/114; 190/109; 190/122; 190/127

[58] Field of Search ..... 190/114, 115, 122, 127, 190/109, 110, 111, 123, 100

[56] References Cited

U.S. PATENT DOCUMENTS

| | | | |
|---|---|---|---|
| 910,713 | 1/1909 | McMahon | 190/109 |
| 1,468,816 | 9/1923 | Johnson | 190/127 X |
| 1,636,060 | 7/1927 | Kennedy | 190/114 |
| 1,658,997 | 2/1928 | Mulford et al. | 190/109 |
| 1,999,064 | 4/1935 | Marks | 190/127 X |
| 2,389,601 | 11/1945 | De Witt | 229/23 |
| 3,023,867 | 3/1962 | Kotkins | 190/113 |
| 3,084,771 | 4/1963 | Davis | 190/113 |
| 3,169,615 | 2/1965 | Stein | 190/114 |
| 3,259,217 | 7/1966 | Platt | 190/115 |
| 3,330,388 | 7/1967 | Stein | 190/110 |
| 3,938,630 | 2/1976 | March | 190/24 |
| 4,374,555 | 2/1983 | March | 190/114 |

FOREIGN PATENT DOCUMENTS

| | | | |
|---|---|---|---|
| 24970 | 11/1883 | Fed. Rep. of Germany | 190/114 |
| 374068 | 11/1962 | France | 190/114 |
| 142251 | 5/1920 | United Kingdom | 190/54 |

*Primary Examiner*—William Price
*Assistant Examiner*—Sue A. Weaver
*Attorney, Agent, or Firm*—Fitch, Even, Tabin & Flannery

[57] ABSTRACT

A carrying case of the type having its bottom and sidewalls formed of a U-shaped unitary member is provided which employs a structural frame made of a plurality of rigid members which are secured to one another by rivets. The frame includes upper and lower pairs of metal bars extending generally horizontally on opposite sides of the case between generally rectangular end shells which may have U-shaped metal guards disposed on their sides and bottoms. The bars are preferably made of spring steel so that they may return to their original shapes after being distorted by overloading of the case. The end shells may have integral nodes formed on them to partially shield exposed ends of the U-shaped guards.

5 Claims, 5 Drawing Figures

FIG. 1
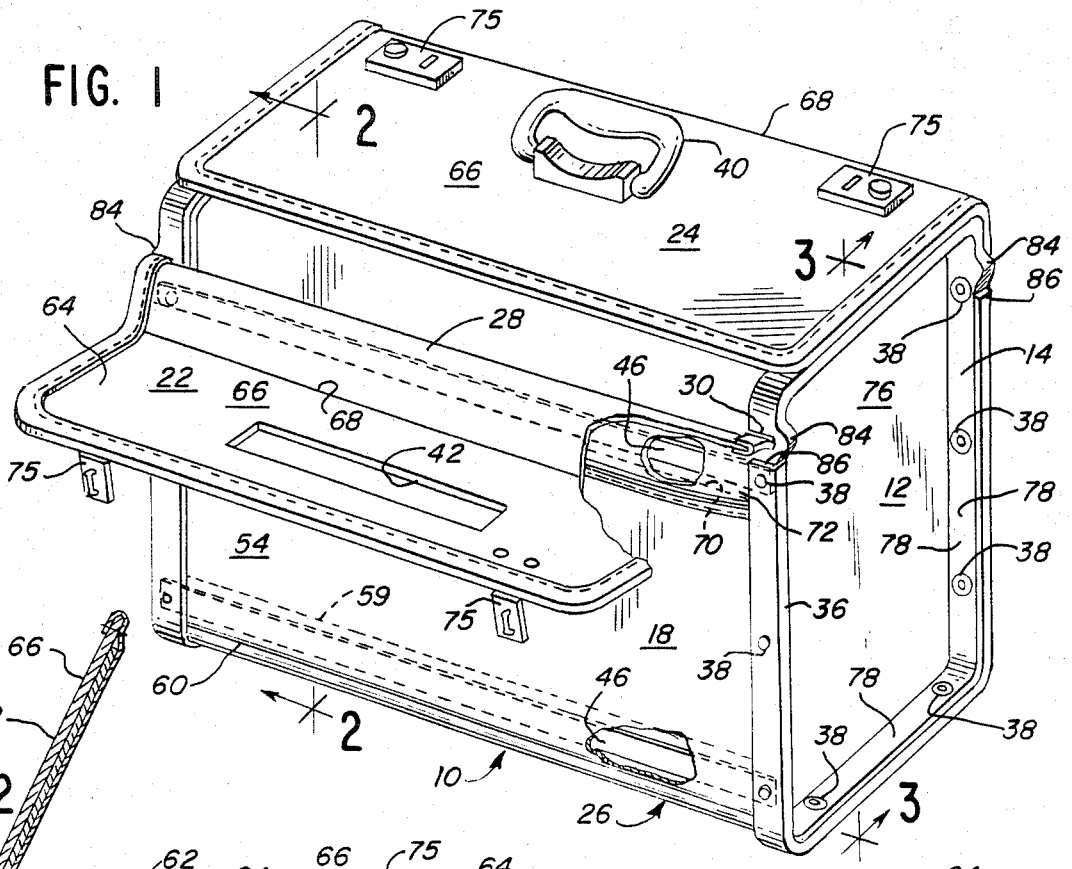
FIG. 2
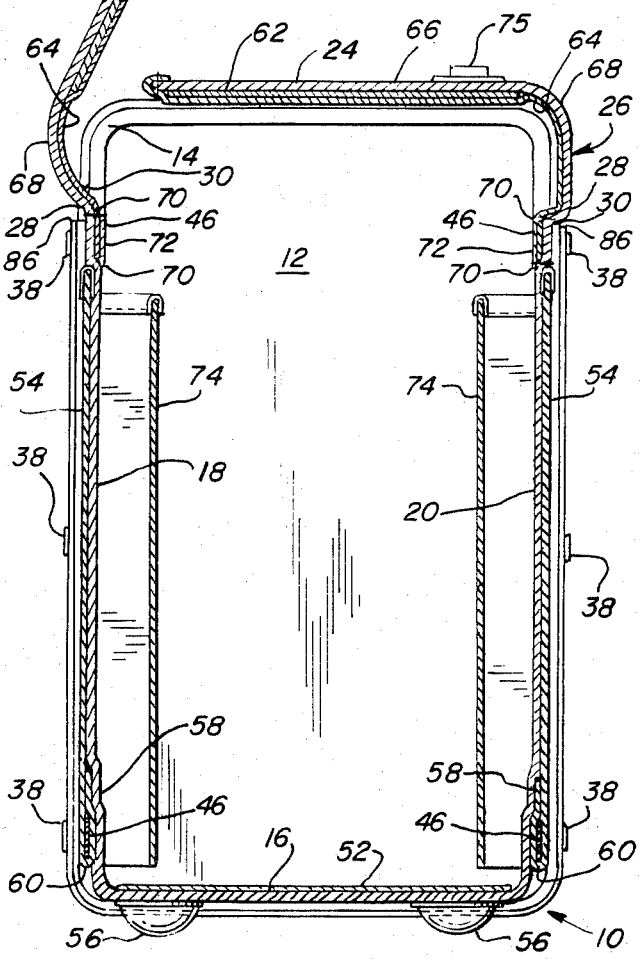
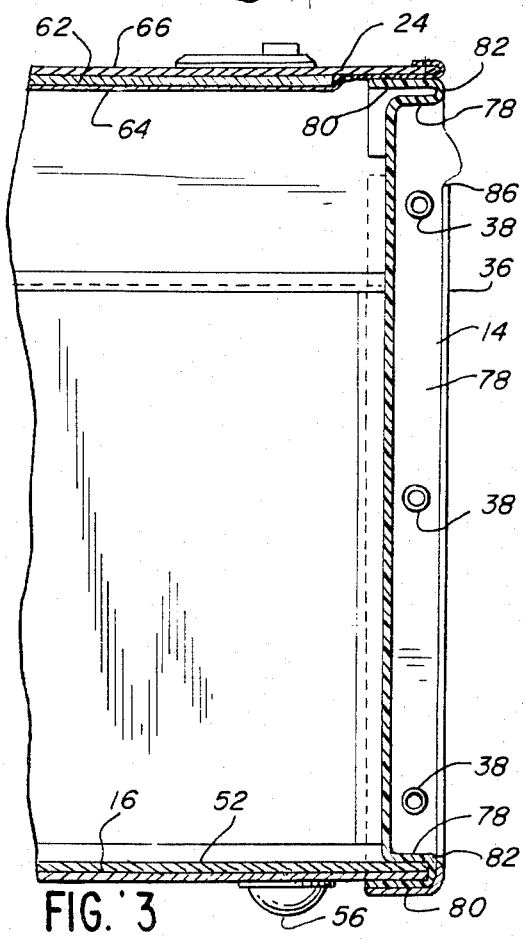
FIG. 3

FIG. 4
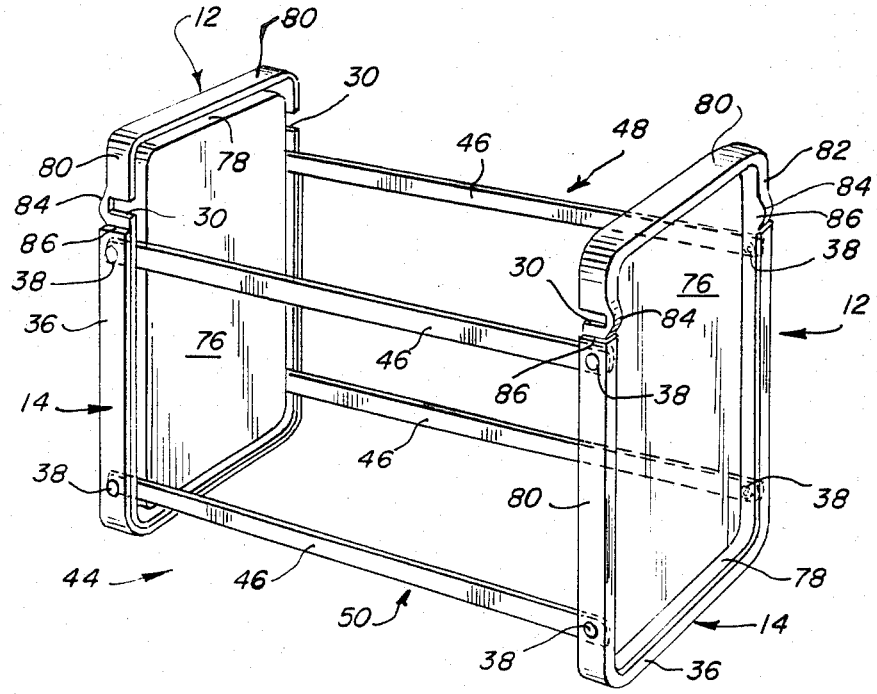
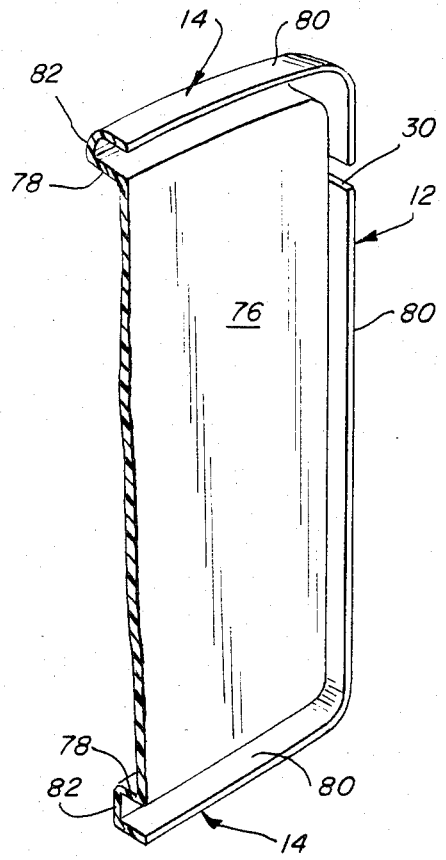
FIG. 5

CARRYING CASE

BACKGROUND OF THE INVENTION

This application is a continuation-in-part of application Ser. No. 228,672 entitled "Carrying Case with Guards", filed Jan. 26, 1981, U.S. Pat. No. 4,374,555.

The present invention relates generally to an article of hand luggage and in particular concerns a more durable carrying case.

Generally those forms of luggage which are adapted to be carried by hand must be relatively light in weight so as to avoid adding unnecessary weight to the load being carried. At the same time the article must have a relatively rigid structure so that it is adaptable for carrying relatively heavy loads, such as catalogs, samples, etc., without being twisted or deformed.

Platt U.S. Pat. No. 3,259,217 discloses such a product which has proven to be a commercial success. In Platt, a unitary member constitutes the bottom and sidewalls of a carrying case; the unitary member is secured by stitches within channels defined by peripheral flanges of rigid, generally rectangular end shells. Lid flaps are pivotally stitched to the unitary member in such manner that the case may be opened and closed. The Platt case is attractive in appearance and durable in use. Its end shell plus unitary wall construction provides a rigid structure with significant structural strength and load-bearing properties.

Another commercially successful case of generally similar construction is described in above referenced U.S. Pat. No. 4,374,555. This case has U-shaped guards affixed to the peripheral flanges of the end shells and employs rivet assemblies to secure the guards to the end shells and to secure the ends of the unitary member within inwardly facing channels defined by the flanges of the end shells. A cardboard plate is affixed to the bottom wall and has its ends riveted within the channels of the end shells. Elongated reinforcing strips of a material such as steel or other metal are disposed along the upper side walls adjacent the flaps.

Although the above cases have exhibited satisfactory strength and durability, when subjected to extremely rough handling such cases have been susceptible to failure due to separation of one or more of the end shells from the unitary member. The cases are commonly used to transport heavy objects such as books and samples, and when a case containing such materials is handled roughly, the impact forces generated by the materials striking the interiors of the end shells may be substantial. In addition, the guards may catch on protruding corners and the like as the case is transported, which may also generate substantial forces on the end shells. Repeated application of such impact forces causes the rivets near the bottom of the case to strain the material of the U-shaped unitary member and reinforcing plate and eventually causes the rivets to tear free.

SUMMARY OF THE INVENTION

In accordance with the present invention, an improved carrying case of the type having its bottom and sidewalls formed of a U-shaped unitary member is provided which employs a structural frame made of a plurality of rigid members riveted together to enable the case to withstand mishandling and abuse better than prior cases of its kind. The frame includes a pair of opposed end shells connected by a plurality of metal bars extending generally horizontally along each side of the case between the end shells, at the upper and lower portions thereof. Each of the end shells comprises a relatively rigid central panel and a peripheral channel within which the opposite ends of the unitary member and the metal bars are disposed. A plurality of rivets secure the ends of the metal bars to the peripheral channels. U-shaped metal guards may be disposed on the exteriors of the peripheral channels to reinforce the plastic material. The bars are preferably made of spring steel so that they will return to their undeformed shapes after being flexed by overloading of the case.

Where U-shaped guards are employed, the end shells herein have nodes formed on their peripheral channels to shield exposed ends of the U-shaped guards so that the risk of damage to clothing and the like is reduced.

BRIEF DESCRIPTION OF THE DRAWINGS

FIG. 1 is a perspective view of a carrying case embodying the present invention.

FIG. 2 is a sectional view of the carrying case shown in FIG. 1 taken along line 2—2 of FIG. 1.

FIG. 3 is a partial sectional view of the carrying case shown in FIG. 1 taken along line 3—3 of FIG. 1.

FIG. 4 is a perspective view of the frame of the carrying case shown in FIG. 1.

FIG. 5 is a fragmentary perspective view of one of the end shells of the carrying case shown in FIG. 1.

DESCRIPTION OF THE PREFERRED EMBODIMENT

The present invention is embodied in a carrying case, shown generally at 10, which includes a pair of end shells 12 having inwardly facing peripheral channels 14 for receiving opposite ends of a bottom wall 16 and a pair of upstanding sidewalls 18 and 20. A pair of lid flaps 22 and 24 extend generally upwardly from the sidewalls 18 and 20. The bottom wall 16, sidewalls 18 and 20, and lid flaps 22 and 24 are integral parts of a unitary member, indicated generally at 26, which has flexible portions 28 where the lid flaps meet the sidewalls to enable the lid flaps to pivot for opening and closing the case. Slots 30 are formed in the peripheral channels of the end shells 12 adjacent the flexible portions 28 of the unitary member 26 so that the end edges of the bottom and sidewalls member may be disposed within the channels 14 while the lid flaps 22 and 24 are disposed entirely outside of the channels. In the illustrated embodiment, U-shaped guards 36 are disposed about the portions of the peripheral channels 14 which receive the end edges of the bottom wall 16 and sidewalls 18 and 20. Rivets 38 fasten the end edges within the interiors of the peripheral channels 14. The underlying lid flap 24 is provided with a handle 40 which extends upwardly through a rectangular opening 42 in the overlying lid flap 22 when the carrying case is closed so that the case may be conveniently carried.

In the past, carrying cases of this type have relied substantially upon riveted connections between the end shells and the unitary member to maintain the structural integrity of the case. Such cases have been susceptible to damage due to localized failure of the material of the unitary member surrounding the rivet assemblies, particlarly at the rivet connections near the bottom of the unitary member.

In accordance with the present invention, an improved carrying case 10 is provided wherein a structrual frame 44 (FIG. 4) made of a plurality of rigid members is employed to strengthen the case and particularly to prevent the end shells 12 from separating from the lower portions of the unitary member 26. The frame 44 includes the end shells 12 and a plurality of elongated thin metal bars 46 which extend along the respective sides of the case at the respective upper and lower portions thereof and which are secured at opposite ends to the end shells by the rivets 38 which extend through the end edges of the sidewalls. The end shells are preferably made of a relatively hard, rigid plastic material. The metal bars 46 ensure that the end shells 12 cannot be pulled away from the unitary member 26 without failure of one or more of the rigid frame members 12, 46. This provides a substantial advantage over prior cases wherein the strength of materials such as cardboard and laminated leatherette was relied upon to maintain the structural integrity of the case. In the illustrated embodiment, the U-shaped metal guards 36 contribute additional strength to the frame at the rivet connections.

In the preferred embodiment of the present invention the frame 44 includes first and second pairs 48 and 50 respectively (FIG. 4) of thin metal bars 46 disposed horizontally along the respective sides of the case. The first pair of bars 46 are disposed adjacent upper portions of the sidewalls 18, 20, and the second pair of bars 50 are disposed adjacent lower portions of the sidewalls. The preferred bars 46 are made of spring steel so that the bars may be flexed, as by overloading of the case, without being permanently deformed.

Referring now in greater detail to the drawings, the unitary member 26 is formed of a single sheet of relatively durable material such as laminated leatherette. As shown in FIGS. 2 and 3, the bottom wall 16 is reinforced by a bottom plate 52 made of stiff cardboard or the like. The plate 52 is preferably secured to the upper surface of the bottom wall by a combination of glue and rivets (not shown).

Exterior pockets members 54 are attached to the sidewalls of the case. Each pocket member comprises a generally rectangular sheet of material which has its opposite ends disposed within respective channels 14 and which has its bottom edge 58 folded up and secured by a row of stitches 59 to the unitary member and to the pocket member to form a sheath 60 for one of the metal bars 46 of the second pair 50.

Each of the lid flaps 22 and 24 has a generally planar end portion 66 and a bent portion 68 adjacent thereto to conform the lid flaps to the end shells 12 when in closed position. The planar portion 66 of each lid flap is reinforced by a cardboard plate 62. Inner liners 64 cover the interiors of the lid flaps 22 and 24 and upper portions of the sidewalls 18 and 20 and are secured to the upper portions of the sidewalls by parallel rows of stitching 70 to form sheaths 72 for the first pair 48 of metal bars 46. Each of the lid flaps is provided with lock assemblies 75.

The bottom wall 26 is generally provided with feet 56 which project downwardly from the lower surface thereof and serve to support the case when it is in an upright position as shown in FIG. 1. The feet 54 are preferably secured to the bottom wall 26 and plate 52 by rivets (not shown).

To increase the usefulness of the carrying case, a plurality of partitions 74 are preferably provided which divide the interior of the case into discrete compartments. The partitions preferably have their opposite ends disposed within the peripheral channels 14 of the end shells 12 and secured within the channels by the rivets 38.

Describing the end shells in greater detail with particular reference to FIGS. 4 and 5, the end shells 12 are made of relatively rigid plastic and include textured, roughly rectangular central panels 76 which form the end walls of the case. The inwardly facing peripheral channel 14 on each end shell 12 includes a generally planar inner portion 78 which is generally perpendicular to the panel, a generally planar outer portion 80 which is substantially parallel to the inner portion, and a curved portion 82 which joins the inner and outer portions. The slots 30 which permit the end edges of the unitary member 26 to pass from the interior to the exterior of the channel are formed in the outer portions 80 of the peripheral channels 14 of the end shells 12.

In the illustrated embodiment, the U-shaped guards 36 are disposed about the peripheral channels 14 of the end shells 12 along the portions corresponding to the bottom 16 and sidewalls 18, 20 of the unitary member 26. Each of the guards 36 has an L-shaped cross section and covers the adjacent outer portion 80 and curved portion 82 of its associated channel 14. In this embodiment, the end shells have nodes 84 formed on their peripheral channels 14 to shield the exposed ends 86 of the U-shaped guards 36 at least partially to reduce the risk of damage to clothing and the like due to contact with the exposed ends.

From the foregoing, it may be seen that a novel and improved carrying case 10 is provided wherein a structural frame 44 adds substantially to the strength of the case and enables it to maintain its structural integrity under conditions which would otherwise damage it. The structural frame 44 is made up of a plurality of rigid members 12, 46 interconnected by rivets 38. The preferred frame includes four elongated steel bars 46 which span the length of the case near the top and bottom on both sides. The metal bars 46 thus hold the end shells 12 a fixed distance apart at four spaced non-collinear locations on each shell. As the bars 46 and shells 12 are rigid, this provides a rigid frame wherein no part of an end shell 12 can move relative to any part of the other end shell 12, as distinguished from the arrangement of bars in the co-pending application Ser. No. 228,672 wherein the bars are only at the top, permitting the lower portions of the shells to move apart from each other and the unitary member by tearing of the weaker unitary member at the rivets. Hence, metal supports at non-colinear locations on the respective shells in accordance with the present invention assure that bursting forces that might otherwise cause the end shells 12 to move apart are resisted by the metal bars 46, thereby acting to prevent the end shells 12 from separating from the unitary member 26. The unitary member 26 performs a structural function in that it prevents the various frame members from pivoting relative to one another about their riveted joints. The U-shaped metal guards 36 which are included in the illustrated embodiment contribute additional strength to the frame.

While preferred embodiments have been illustrated and described hereinabove, various changes and modifications may be made in the above-described article without deviating from the spirit and scope of the present invention. Various features of the present invention are set forth in the following claims.

What is claimed is:

1. A carrying case having two sides, two ends, a top and a bottom for carrying relatively heavy loads, said carrying case comprising:

a frame including a pair of relatively rigid, integral end shells and first and second pairs of elongated metal bars extending between said end shells and riveted thereto, said first pair of bars being disposed adjacent upper portions of said end shells, and said second pair being disposed adjacent lower portions of said end shells, for supporting said end shells in fixed position relative to each other, each of said end shells including a generally rectangular panel surrounded by a generally rectangular peripheral channel and forming a respective end of said carrying case, each of said peripheral channels having a generally horizontal bottom portion adjacent the bottom of the panel, and two generally vertical side portions adjacent the respective sides of the panel;

a unitary member having a bottom and first and second sidewalls extending upwardly from opposite sides of the bottom, said member forming the bottom and sides of said carrying case and each of the ends of said bottom and sidewalls of said member being secured within the bottom and side portions of a respective said peripheral channel; and a pair of generally rectangular pocket members forming exterior pockets, one secured to each sidewall;

each of said pocket members spanning the length of its associated sidewall and being secured at its opposite ends to respective said end shells;

each of said pocket members having its lower edge folded up and stitched to the respective pocket member and the adjacent sidewall so that the stitching forms a closed bottom for the pocket and forms an elongated sheath beneath the stitching, said second pair of bars being disposed within the respective sheaths of the pocket members.

2. A carrying case having two sides, two ends, a top and a bottom for carrying relatively heavy loads, said carrying case comprising:

a frame including a pair of relatively rigid, integral end shells and first and second pairs of elongated metal bars extending between said end shells and riveted thereto, said first pair of bars being disposed adjacent upper portions of said end shells, and said second pair being disposed adjacent lower portions of said end shells, for supporting said end shells in fixed position relative to each other, each of said end shells including a generally rectangular panel surrounded by a generally rectangular peripheral channel and forming a respective end of said carrying case, each of said peripheral channels having a generally horizontal bottom portion adjacent the bottom of the panel, and two generally vertical side portions adjacent the respective sides of the panel;

a unitary member having a bottom and first and second sidewalls extending upwardly from opposite sides of the bottom, said member forming the bottom and sides of said carrying case and each of the ends of said bottom and sidewalls of said member being secured within the bottom and side portions of a respective said peripheral channel; and a pair of inner liners affixed to inner surfaces of said sidewalls by parallel rows of stitching to form sheaths for said first pair of bars.

3. A carrying case having two sides, two ends, a top and a bottom for carrying relatively heavy loads, said carrying case comprising:

a frame including a pair of relatively rigid, integral end shells, a pair of U-shaped metal guards disposed about lower peripheral portions of said end shells, upper and lower pairs of elongated metal bars extending between said end shells, and a plurality of rivets fastening each of said end shells and U-shaped guards to respective opposite ends of said metal bars, said upper pair of bars being disposed adjacent upper portions of said end shells, and said lower pair being disposed adjacent lower portions of said end shells for supporting said end shells in fixed position relative to each other, each of said end shells including a generally rectangular panel surrounded by a generally rectangular peripheral channel, and forming a respective end of said carrying case, each of said peripheral channels having a generally horizontal bottom portion adjacent the bottom of the panel, two generally vertical side portions adjacent the respective sides of the panel, and a generally horizontal top portion adjacent the top of the panel;

each of said U-shaped metal gaurds having a generally horizontal bottom portion and a pair of side portions extending upwardly therefrom; and a unitary member having a bottom and first and second sidewalls extending upwardly from opposite sides of the bottom, said member forming the bottom and sides of said carrying case, each of the ends of said bottom and sidewalls of said member being secured within the bottom and side portions of a respective one of said peripheral channels; and each said end shell having nodes formed on its peripheral channel directly above the side portions of said U-shaped metal guards.

4. A carrying case having two sides, two ends, a top and a bottom for carrying relatively heavy loads, said carrying case comprising:

a frame including a pair of relatively rigid, integral end shells, a pair of U-shaped metal guards disposed about lower peripheral portions of said end shells, upper and lower pairs of elongated metal bars extending between said end shells, and a plurality of rivets fastening each of said end shells and U-shaped guards to respective opposite ends of said metal bars, said upper pair of bars being disposed adjacent upper portions of said end shells, and said lower pair being disposed adjacent lower portions of said end shells for supporting said end shells in fixed position relative to each other, each of said end shells including a generally rectangular panel surrounded by a generally rectangular peripheral channel, and forming a respective end of said carrying case, each of said peripheral channels having a generally horizontal bottom portion adjacent the bottom of the panel, two generally vertical side portions adjacent the respective sides of the panel, and a generally horizontal top portion adjacent the top of the panel;

each of said U-shaped metal guards having a generally horizontal bottom portion and a pair of side portions extending upwardly therefrom; and a unitary member having a bottom and first and second sidewalls extending upwardly from opposite sides of the bottom, said member forming the bottom and sides of said carrying case, each of the ends of said bottom and sidewalls of said member being secured within the bottom and side portions of a respective one of said peripheral channels; and a pair of generally rectangular pocket members forming exterior pockets, one secured to each sidewall, each of said pocket members spanning the length of its associated sidewall and being secured at its opposite ends to respective said end shells, each of said pocket members having its lower edge folded up and stitched to the respective pocket member and to the adjacent sidewall so that the stitching forms a closed bottom for the pocket and forms an elongated sheath beneath the stitching, said second pair of bars being disposed within the respective sheaths of the pocket members.

5. A carrying case for carrying relatively heavy loads comprising:

a unitary member having a bottom, first and second sidewalls extending upwardly from opposite sides of the bottom, and first and second mutually cooperable lid flaps extending generally upwardly from said first and second sidewalls respectively and pivotable between open and closed positions, said lid flaps being configured to overlap partially when in closed position so that said first lid flap is partially covered by said second lid flap, a pair of generally rectangular pocket members forming exterior pockets, one secured to each sidewall, each of said pocket members spanning the length of its associated sidewall, each of said pocket members having its lower edge folded up and stitched to the pocket member and to the adjacent sidewall so that the stitching forms a closed bottom for the pocket and forms an elongated sheath extending along the bottom of the pocket, inner liners covering interior portions of said unitary member and being secured thereto by parallel rows of stitching to form sheaths adjacent upper portions of said sidewalls, a handle secured to said first lid flap and positioned to extend through an opening in said second lid flap when said lid flaps are in closed position, locking means for maintaining said lid flaps in closed position, and a frame including a pair of relatively rigid, integral end shells fastened to respective opposite ends of said unitary member, a pair of U-shaped metal guards disposed about lower peripheral portions of said end shells, and first and second pairs of elongated spring steel bars extending between said end shells and riveted to said end shells and to said U-shaped metal guards for supporting said end shells in fixed position relative to each other, said first pair of bars being disposed within the sheaths adjacent upper portions of the respective sidewalls, and said second pair being disposed within the respective sheaths extending along the bottoms of the pockets, each of said U-shaped members having a generally horizontal bottom portion and a pair of side portions extending upwardly therefrom, each of said bottom and side portions having an L-shaped cross section, each of said end shells including a generally rectangular panel surrounded by a generally rectangular peripheral channel, each of said peripheral channels having a generally horizontal bottom portion adjacent the bottom of the panel, two generally vertical side portions adjacent the respective sides of the panel, and a generally horizontal top portion adjacent the top of the panel, each of the ends of said bottom and sidewalls being secured within the bottom and side portions of one of said peripheral channels, each of said peripheral channels having nodes formed on its vertical side portions directly above the side portions of the U-shaped guards and having slots formed adjacent said nodes to enable the end portions of said unitary member to pass from within the peripheral channels to the exteriors of said peripheral channels.

* * * * *